US010870573B2

(12) United States Patent
Minehardt et al.

(10) Patent No.: US 10,870,573 B2
(45) **Date of Patent: *Dec. 22, 2020**

(54) METHOD OF MAKING BLOWABLE FLOCCULE INSULATION

(71) Applicant: PRIMALOFT, INC., Latham, NY (US)

(72) Inventors: Jon-Alan Minehardt, Clifton Park, NY (US); Vanessa Mason, Rexford, NY (US)

(73) Assignee: PRIMALOFT, INC., Latham, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/371,445

(22) Filed: Apr. 1, 2019

(65) Prior Publication Data

US 2019/0225484 A1 Jul. 25, 2019

Related U.S. Application Data

(62) Division of application No. 15/762,960, filed as application No. PCT/US2016/054298 on Sep. 29, 2016, now Pat. No. 10,633,244.

(Continued)

(51) Int. Cl.
*D04H 1/00* (2006.01)
*D04H 1/736* (2012.01)

(Continued)

(52) U.S. Cl.
CPC ..... *B68G 1/00* (2013.01); *A41D 31/06* (2019.02); *D04H 1/00* (2013.01); *D04H 1/736* (2013.01);

(Continued)

(58) Field of Classification Search
None
See application file for complete search history.

(56) References Cited

U.S. PATENT DOCUMENTS 3,892,909 A 7/1975 Miller
4,618,531 A 10/1986 Marcus (Continued)

FOREIGN PATENT DOCUMENTS

CN 1073993 7/1993
CN 1100763 3/1995

(Continued)

OTHER PUBLICATIONS

International Search Report and Written Opinion issued in PCT/US2016/054298 filed Sep. 29, 2016, dated Dec. 19, 2016.

(Continued)

*Primary Examiner* — Mary Lynn F Theisen
(74) *Attorney, Agent, or Firm* — Heslin Rothenberg Farley & Mesiti P.C.

(57) ABSTRACT

The disclosure provides blowable insulation or filling material, and apparatus and methods for making same. The blowable insulation or filling material includes a plurality of discrete elongate floccules each formed of a plurality of fibers. The floccules include a relatively open enlarged medial portion. The floccules also include relatively condensed twisted tail portions extending from opposing ends of the medial portion. The floccules can be utilized by existing garment fill blowing machines without clogging thereof, and include a superior soft hand feel, thermal resistance and launderability. The floccules may be formed by forcing staple fibers through apertures of a rotating hollow drum to partially form the floccule structure within the drum. The partially formed floccules may be retained within the rotating drum for a dwell time to finalize the floccule structure.

20 Claims, 5 Drawing Sheets

Related U.S. Application Data

(60) Provisional application No. 62/234,218, filed on Sep. 29, 2015.

(51) Int. Cl.
*B68G 1/00* (2006.01)
*A41D 31/06* (2019.01)

(52) U.S. Cl.
CPC .... *B68G 2001/005* (2013.01); *D10B 2331/04* (2013.01); *D10B 2401/04* (2013.01)

(56) References Cited

U.S. PATENT DOCUMENTS

| | | | |
|---|---|---|---|
| 5,080,964 | A | 1/1992 | Tesch |
| 5,286,556 | A | 2/1994 | Tesch |
| 5,798,166 | A | 8/1998 | Gross |
| 6,329,051 | B1 | 12/2001 | Groh et al. |
| 6,329,052 | B1 | 12/2001 | Groh et al. |
| 6,589,652 | B2 | 7/2003 | Groh et al. |
| 7,261,936 | B2 | 8/2007 | Davis et al. |
| 7,790,639 | B2 | 9/2010 | Davenport et al. |
| 9,185,941 | B2 | 11/2015 | Mason et al. |
| 9,340,907 | B2 | 5/2016 | Patterson |
| 2004/0241437 | A1 | 12/2004 | Davis et al. |
| 2014/0206796 | A1 | 7/2014 | Allampalayam Jayaraman et al. |

FOREIGN PATENT DOCUMENTS

| | | |
|---|---|---|
| CN | 1288807 | 3/2001 |
| CN | 1352711 | 6/2002 |
| CN | 1355865 | 6/2002 |
| CN | 1535340 | 10/2004 |
| CN | 1579991 | 2/2005 |
| CN | 1688232 | 10/2005 |
| CN | 1809302 | 7/2006 |
| CN | 101173417 | 5/2008 |
| CN | 101297072 | 10/2008 |
| CN | 101743347 | 6/2010 |
| CN | 101917879 | 12/2010 |
| CN | 102028372 | 4/2011 |
| CN | 204112010 | 1/2015 |
| RU | 2345183 | 1/2009 |
| WO | 1991014035 | 9/1991 |
| WO | 0006379 | 2/2000 |
| WO | 03072865 | 9/2003 |
| WO | 2003072865 | 9/2003 |
| WO | 2014116439 | 7/2014 |
| WO | 2016100616 | 6/2016 |
| WO | 2016118614 | 7/2016 |
| WO | 2016191202 | 12/2016 |
| WO | 2016191203 | 12/2016 |
| WO | 2017027260 | 2/2017 |
| WO | 2017087511 | 5/2017 |

OTHER PUBLICATIONS

China National Intellectual Property Administration, Notification of the First Examination Report & Search Report, dated Apr. 7, 2020, 7 pages, Chinese Application No. 201680056750.8.

METHOD OF MAKING BLOWABLE FLOCCULE INSULATION

CROSS-REFERENCE TO RELATED APPLICATIONS

This application is a divisional application of U.S. Provisional application Ser. No. 15/762,960 filed on Mar. 23, 2018, which is a U.S. national phase entry under Section 371 of International Application No. PCT/US2016/054298, filed on Sep. 29, 2016, which claims priority to U.S. Provisional Application No. 62/234,218, filed on Sep. 29, 2015. The entire contents of each of these prior applications is hereby incorporated herein by reference in their entireties.

FIELD OF THE DISCLOSURE

The present disclosure generally relates to blowable insulation and methods of making same, and more particularly to blowable floccule insulation that mimics down insulation and methods of making same.

BACKGROUND OF THE DISCLOSURE

There have been attempts to achieve an insulating and/or filling material having down-like qualities for use in articles such as clothing, sleeping bags, bedding, and the like. Prior efforts to develop such a material have most often yielded insulation and/or filling materials that are too heavy and dense to be considered down-like and/or cannot properly be utilized by conventional fill blowing equipment. For example, these materials may tend to clog conventional fill blowing equipment and/or resist being fed or loaded into such equipment.

Some prior attempts at polyester insulating products having down-like qualities include a poor hand feel, launderability, fill power and blowing efficiency. As another example, some prior polyester insulating products which have succeeded in creating some down-like qualities and are able to be utilized in typical garment fill blowing machines sacrifice the soft hand feel and launderability of down. These materials tend to stick together and fail to migrate through the article, especially after laundering.

Therefore, there is a need for a manufactured insulation and/or filling material that has the hand feel, launderability and fill power of down, and can be utilized by conventional blowing equipment.

While certain aspects of conventional technologies have been discussed to facilitate disclosure of the disclosure, Applicant in no way disclaims these technical aspects, and it is contemplated that the claimed disclosure may encompass one or more of the conventional technical aspects discussed herein.

In this specification, where a document, act or item of knowledge is referred to or discussed, this reference or discussion is not an admission that the document, act or item of knowledge or any combination thereof was, at the priority date, publicly available, known to the public, part of common general knowledge, or otherwise constitutes prior art under the applicable statutory provisions; or is known to be relevant to an attempt to solve any problem with which this specification is concerned.

SUMMARY OF THE DISCLOSURE

Briefly, the present disclosure satisfies the need for manufactured insulation and/or filling material that is able to be utilized in typical current garment fill blowing machines and has down-like qualities, such as the hand feel, launderability, fill power and blowing efficiency of down insulation. The present disclosure may address one or more of the problems and deficiencies of the art discussed above. However, it is contemplated that the disclosure may prove useful in addressing other problems and deficiencies in a number of technical areas. Therefore, the claimed disclosure should not necessarily be construed as limited to addressing any of the particular problems or deficiencies discussed herein.

Certain embodiments of the presently-disclosed blowable filling material or insulation, articles comprising the material, and methods for making the material have several features, no single one of which is solely responsible for their desirable attributes. Without limiting the scope of the blowable insulating and/or filling material, articles, and methods as defined by the claims that follow, their more prominent features will now be discussed briefly. After considering this discussion, and particularly after reading the section of this specification entitled "Detailed Description of the Disclosure," one will understand how the features of the various embodiments disclosed herein provide a number of advantages over the current state of the art. For example, incorporation of embodiments of the inventive blowable insulating and/or filling material into articles gives the resultant article an increased softness as sensed by the hand or skin as compared to prior non-down filling material or insulation. Articles comprising the embodiments of the disclosed blowable insulating and/or filling material can also increase the launderability of the articles, and may include an improved fill power and blowing efficiency as compared to prior non-down material. The blowable insulating and/or filling material may also be configured to be utilized by typical fill blowing machines without clogging or other loading issues typically encountered with prior non-down insulating and/or filling material.

In one aspect, the present disclosure provides blowable insulation or filling material. The material may include a plurality of discrete, longitudinally elongated floccules formed of a plurality of fibers. The floccules may include a relatively open enlarged medial portion and relatively condensed twisted tail portions extending from opposing ends of the medial portion.

In some embodiments, the plurality of fibers may be synthetic fibers. In some such embodiments, the plurality of fibers may be formed of polyester. In some embodiments, the plurality of fibers may include a denier within the range of 0.1 D to 8.0 D. In some embodiments, the plurality of fibers may include a longitudinal length within the range of 5 mm to 55 mm. In some such embodiments, the plurality of fibers may include a longitudinal length of less than or equal to 15 mm.

In some embodiments, the longitudinal length of the floccules may be within the range of 2 cm to 4.5 cm. In some embodiments, the longitudinal length of the medial portion of the floccules may be within the range of 0.1 cm to 2 cm. In some embodiments, the longitudinal length of the tail portions of the floccules may be within the range of 0.8 cm to 1.8 cm. In some embodiments, the medial portion may include a total width and a total thickness that are greater than a total width and a total thickness, respectively, of each of the corresponding tail portions. In some such embodiments, the total width of the medial portion may be greater than the total thickness of the medial portion.

In some embodiments, the medial portion and the tail portions may extend substantially linearly along the longitudinal direction. In some other embodiments, at least one of the medial portion and at least one of the tail portions may extend substantially non-linearly along the longitudinal direction. In some embodiments, the plurality of fibers may include fibers that differ in at least one of longitudinal length, denier and composition. In some embodiments, the floccules may each include a total number of individual fibers within the range of about 600 total fibers to about 1,200 total fibers. In some embodiments, the material may include a fill power within the range of 250 and 800 cubic inches per 30 grams. In some embodiments, the material may include loose fibers that are not formed into floccules.

In another aspect, the present disclosure provides an article including the blowable insulation or filling material disclosed herein within a compartment of the article.

In another aspect, the present disclosure provides a method of making blowable insulation or filling material. The method may include rotating a hollow drum including a plurality of apertures extending therethrough within the range of 100 RPM to 400 RPM. The method may further include forming a vacuum pressure within an interior of the rotating drum. The method may also include applying staple fibers to an exterior surface of the rotating drum such that the internal vacuum pulls a plurality of the staple fibers through a plurality of the apertures to partially form a plurality of floccules. The method may further include retaining the partially-formed floccules within the rotating drum for a dwell time within the range of 2 minutes to 5 minutes to form a plurality of discrete, longitudinally elongated floccules each including a relatively open enlarged medial portion and relatively condensed twisted tail portions extending from opposing ends of the medial portion.

In some embodiments, the staple fibers may include a denier within the range of 0.1 D to 8.0 D and a longitudinal length within the range of 5 mm to 55 mm. In some embodiments, the floccules may include a longitudinal length within the range of 2 cm to 4.5 cm.

These and other features and advantages of the present disclosure provides will become apparent from the following detailed description of the various aspects of the present disclosure provides taken in conjunction with the appended claims and the accompanying drawings.

BRIEF DESCRIPTION OF THE DRAWINGS

The subject matter, which is regarded as the disclosure, is particularly pointed out and distinctly claimed in the claims at the conclusion of the specification. The foregoing and other features, aspects, and advantages of the disclosure will be readily understood from the following detailed description taken in conjunction with the accompanying drawings, wherein:

DETAILED DESCRIPTION OF THE DISCLOSURE

Figure 1:
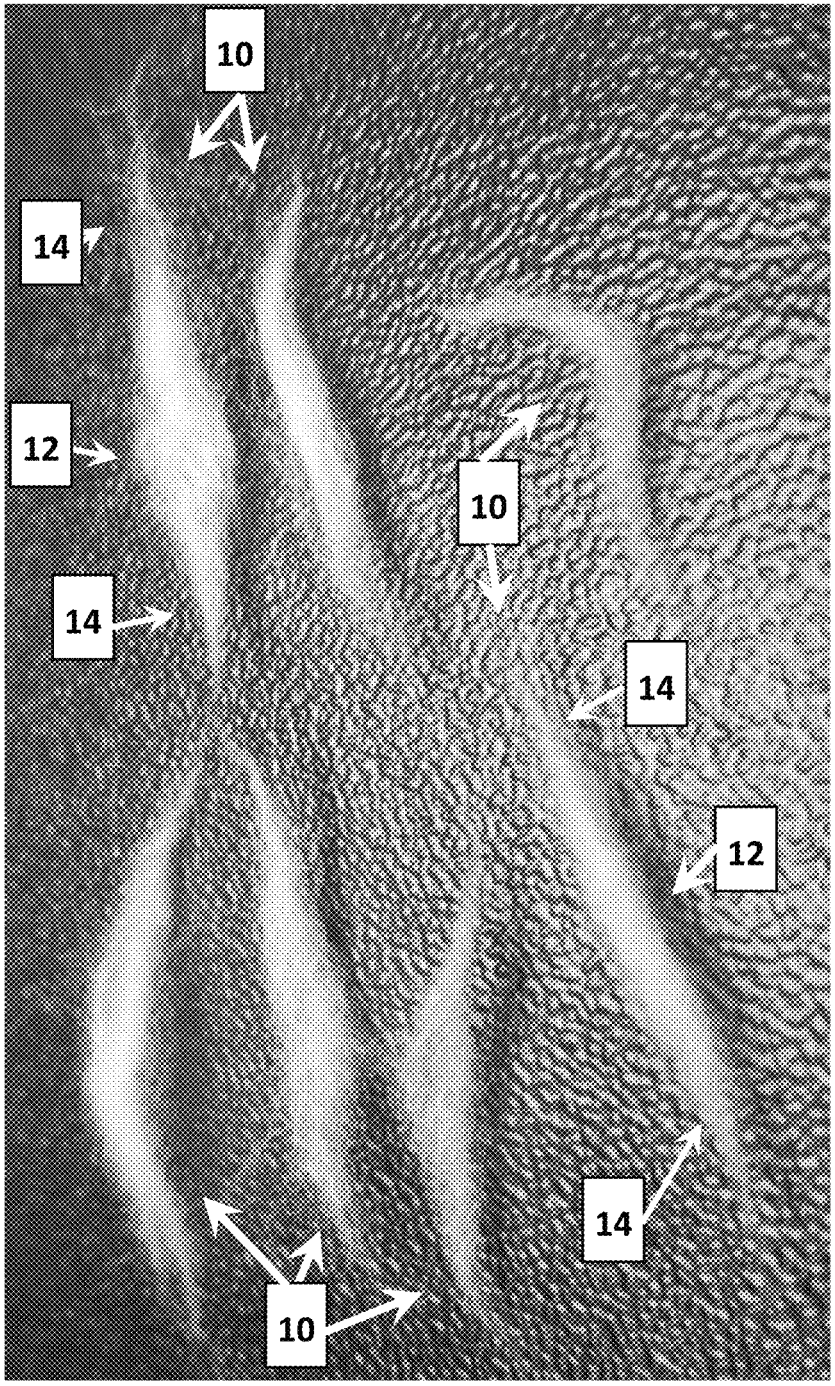
FIG. 1 illustrates an elevational perspective view of a plurality of floccules of blowable insulation and/or filling material according to certain embodiments of the present disclosure.
Figure 2:
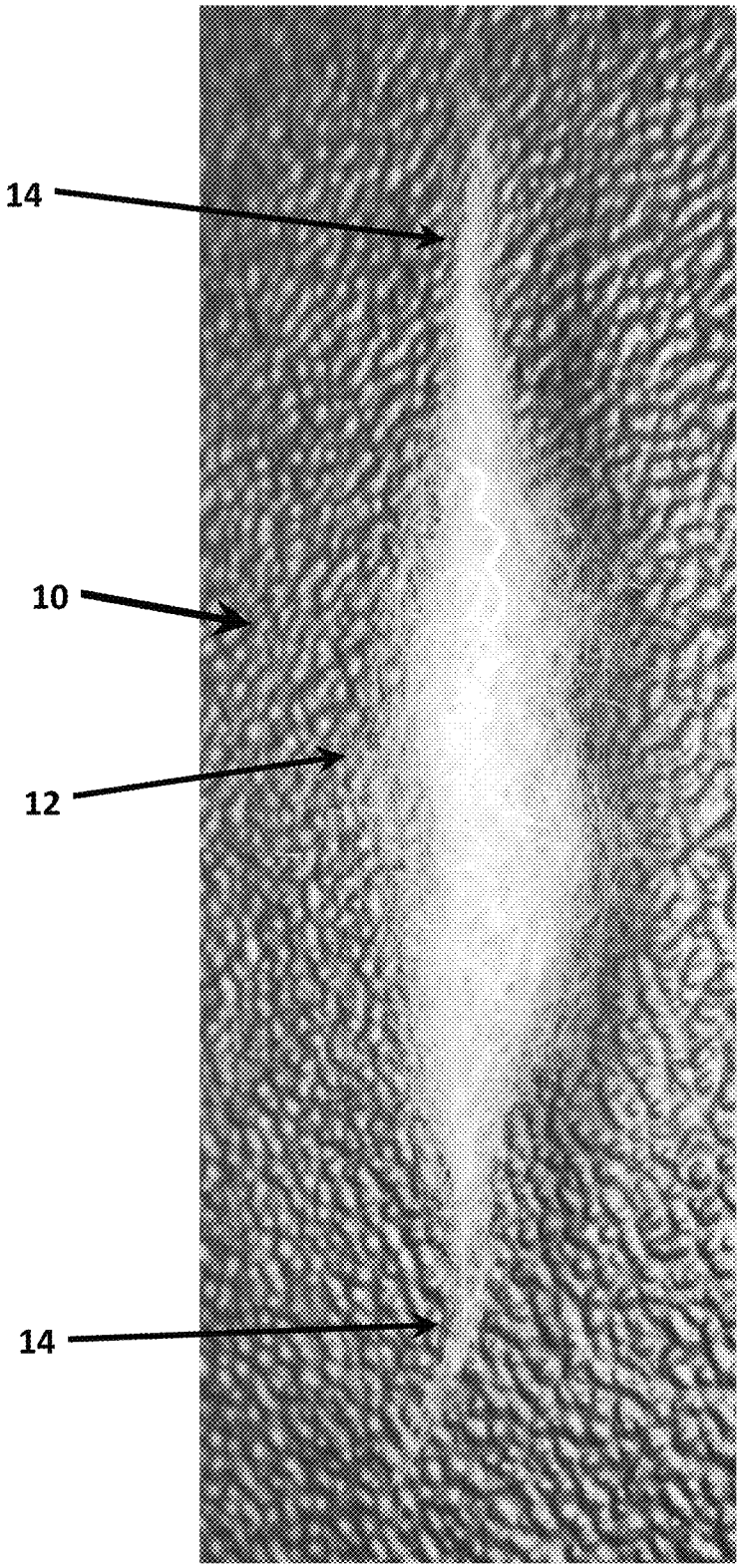
FIG. 2 illustrates an elevational perspective view of an exemplary floccule according to the present disclosure.

Aspects of the present disclosure and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the disclosure in detail. It should be understood, however, that the detailed description and the specific example(s), while indicating embodiments of the disclosure, are given by way of illustration only, and are not by way of limitation. Various substitutions, modifications, additions and/or arrangements within the spirit and/or scope of the underlying concepts will be apparent to those skilled in the art from this disclosure.

Reference will be made below in detail to exemplary embodiments of the disclosure, examples of which are illustrated in the accompanying drawings. Wherever possible, the same reference numerals used throughout the drawings refer to the same or like aspects.

The present disclosure provides blowable filling material or insulation made of tufts of fibers (natural and/or synthetic) that are structured in a way to form floccules with characteristics of a down cluster, down fiber, and/or feather. Generally, the floccules are a collection of fibers that are formed into an elongate structure with an expanded, loose medial portion and slender, tight, twisted tail portions extending from opposing ends of the medial portion. Like down clusters, down fibers, and/or feathers, the floccules can be utilized by existing garment fill blowing machines without clogging thereof. For example, the floccules of the present disclosure prevent clogging of a traditional or typical garment fill blowing machine by naturally aligning in the air current flowing through a blowing nozzle thereof and by forming and maintaining a free flowing nature with each other. Further, the structure of the floccules prevents them from falling rapidly to the bottom of the blowing machine (i.e., "float" for an extended period of time) and thereby avoiding being drawn up by the blowing machine. Still further, the floccules are configured to prevent clumping and roping thereof as they are drawn through a blowing machine.

The floccules are further configured to include a superior soft hand feel, thermal resistance and launderability, also like down clusters, down fibers, and/or feathers. For example, the structure of the floccules keeps them moving freely through an article while not compromising a soft hand feel. The floccules provide improved launderability because the structure allows them to easily separate from each other and freely move with respect to each other once dried. Regarding thermal resistance, the floccules are configured such that they provide loft that creates air pockets which, in turn, increase thermal resistance. In these way, the present disclosure provides blowable filling material or insulation formed of floccules that act, appear, launder, and are employed, in the same or substantially similar manner as down clusters, down fibers, and/or feathers.

As shown in FIGS. 1-6, the floccules 10 of the blowable filling material or insulation of the present disclosure are formed of or by a plurality of individual synthetic or natural fibers organized into a defined structure. For the purposes of this disclosure, the term "floccule" refers to a tuft of synthetic or natural fibers or filaments. While only a single or particular floccule 10 is depicted in FIGS. 1-6 and described herein below, the blowable filling material or insulation according to the present disclosure may include a plurality of floccules 10. Each of the plurality of floccules 10 of the blowable filling material or insulation according to the present disclosure may vary, slightly, from each other. However, at least the general configuration or structure of each floccule 10, as described further below, may be the same or substantially similar. In some embodiments, the blowable filling material or insulation may include a plurality of floccules 10 and loose or non-organized fibers (e.g., fibers not formed into the floccule structures 10). In one example, the loose fibers do not make up more than about 5 wt % of the blowable filling material or insulation. The floccules 10 may be configured such that the resulting blowable filling material or insulation formed thereof includes a fill power within the range of about 250 to about 800 cubic inches per about 30 grams.

In some embodiments, a floccule 10 may include a relatively open enlarged medial portion 12 and relatively condensed narrow tail portions 14 extending from the medial portion 12, as shown in FIGS. 1-6. The tail portions 14 may define opposing free ends that define the longitudinal ends of the floccules 10. The medial 12 and tail 14 portions, and thereby a floccule 10 as a whole, may be substantially elongated along a longitudinal direction. In some embodiments, the medial 12 and tail 14 portions may be substantially aligned along the longitudinal direction. The medial 12 and/or tail 14 portions may extend substantially linearly along the longitudinal direction. In some alternative embodiments (not shown), the medial 12 and/or tail 14 portions may be arcuate or curved such that the floccule 10, as a whole, forms a convex or concave shape.

Figure 3:
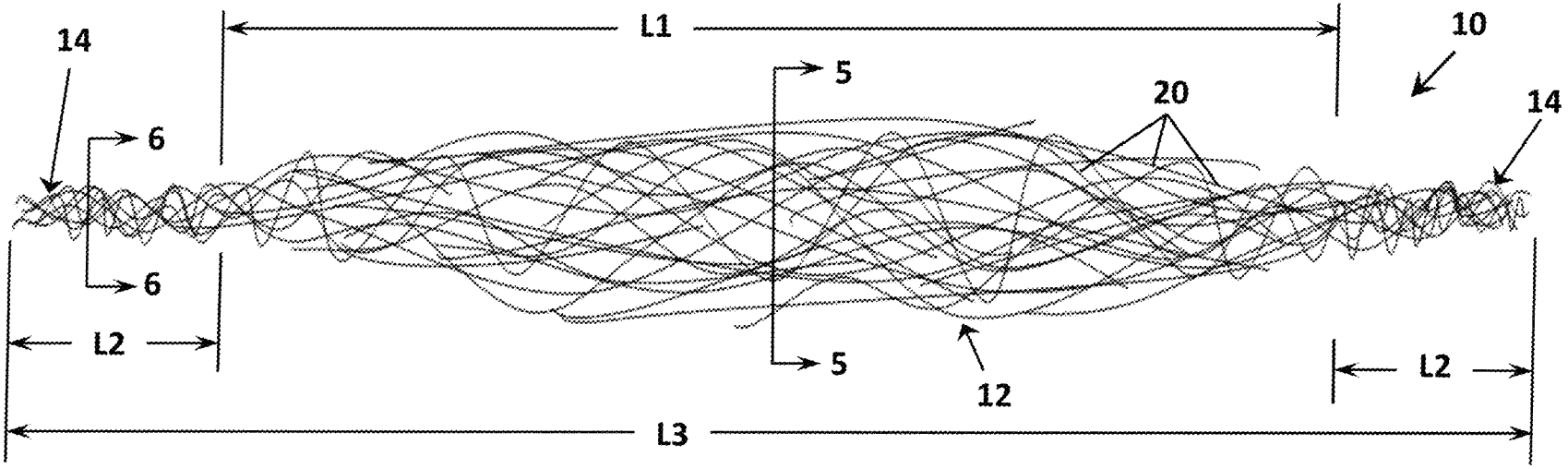
FIG. 3 illustrates a top view of the floccule of FIG. 2.

As shown in FIG. 3, the medial portion 12 of the floccule 10 may extend longer in the longitudinal direction than each of the tail portions 14. While the transition between the medial portion 12 and the tail portions 14 may be gradual, for purposes of this disclosure the tail portions 14 of the floccules 10 are defined as the portions in which the majority of fibers 20 are arranged in a twisted or spiraling arrangement with each other as a whole. As indicated in the top view of FIG. 3, the medial portion 12 may define a maximum longitudinal length L1 that is greater than the maximum longitudinal length L2 of the tail portions 14. However, in some floccules 10 the length L1 of the medial portion is equal to or less than the length L2 of at least one of the corresponding tail portions 14. The lengths L2 the tail portions 14 of a particular floccule 10 may be substantially the same or may differ from each other. In some embodiments, the length L1 of the medial portion may be within the range of about 0.1 cm to about 2 cm, or within the range of about 1 cm to about 1.8 cm. In some embodiments, the length L2 of the tail portion 14 may be within the range of about 0.8 cm to about 1.8 cm, or within the range of about 1 cm to about 1.5 cm. The total length longitudinal length L3 of a floccule 10 extending between free ends of the tail portion 14 may be within the range of about 2 cm to about 4.5 cm, or about 2.5 cm to about 4 cm. In some embodiments, blowable insulation or filling material formed of a plurality of floccules 10 may include an average total floccule length L3 of about 3.5 cm, an average tail portion 14 length L2 of about 1.1 cm, and/or an average medial portion 12 length L2 of about 1.2 cm.

Figure 5:
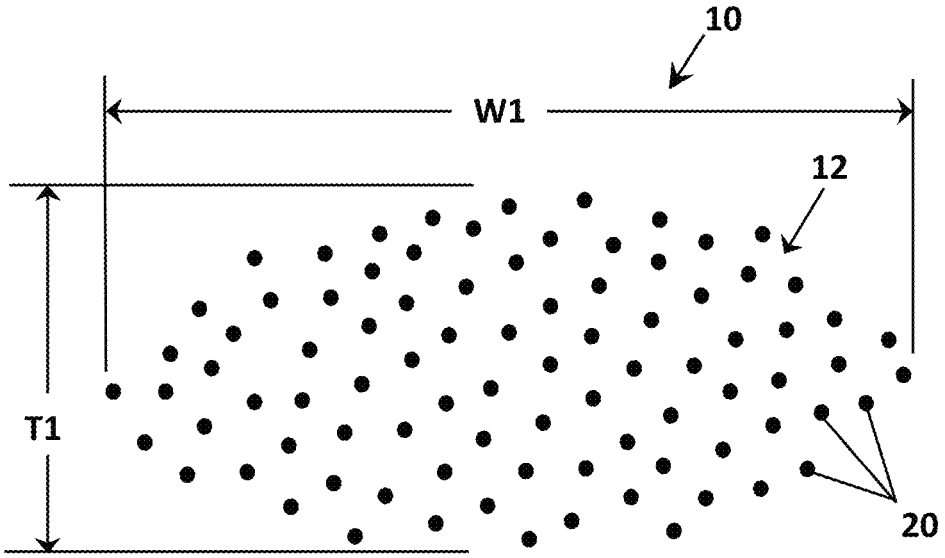
FIG. 5 illustrates a cross-sectional view of an exemplary body portion of the floccule of FIG. 2 as indicated in FIG. 3.

The medial portion 12 may define a maximum width W1 and a maximum thickness T1 of the floccule 10, as shown in the cross-sectional view of FIG. 5. As shown in FIG. 5, the width W1 of the medial portion 12 of the floccule 10 may be larger than the thickness T1 thereof. As also shown in FIG. 5, the medial portion 12 may thereby substantially form an oval or ellipse shape in cross-section. In some embodiments, the cross-sectional shape of the medial portion 12 may be substantially rounded elliptical or substantially pointed elliptical. In other embodiments, the width W1 of the medial portion 12 may be equal to or less than the thickness T1 thereof. In some embodiments, the width W1 of the medial portion 12 may be within the range of about 0.2 cm to about 1 cm, or within the range of about 0.4 cm to about 0.7 cm. In some embodiments, blowable insulation formed of a plurality of floccules 10 may include an average floccule medial portion width W1 within the range of about 0.6 cm to about 0.7 cm.

The fibers 20 that form the floccules 10 may be any fibers 20. For example, the fibers 20 may be synthetic fiber, natural fibers or a combination thereof. In one example, the fibers 20 forming the floccules 10 may be formed, at least in part, of polyester, polypropylene, viscose rayon (i.e., tencil), poly lactic acid, carbon (e.g., solid or nano-tube carbon fibers), polyester conjugate and/or shape changing materials, and combinations thereof. In some embodiments the floccules 10 may be formed of fibers 20 of a single compositions (e.g., polyester), and in other embodiments the floccules 10 may be formed of a blend of fibers 20 of differing compositions.

Similar to the composition of the fibers 20, the configuration of the fibers 20 forming a particular floccule 10 may be uniform, or the floccule 10 may be formed of a blend of fibers 20 of differing configurations. For example, the fibers 20 of a particular floccule 10 may be of a substantially uniform length and/or denier, or the fibers 20 may vary in at least one of their length and denier. In some embodiments, the denier of the fibers 20 may be within the range of about 0.1 D to about 8.0 D. The length of fibers 20 may be within the range of about 5 mm to about 55 mm, or within the range of about 5 mm to about 14 mm.

The composition and/or configuration of the fibers 20 forming the floccules 10 can thereby be tuned to suit a particular need or use, while maintaining the down-like qualities described above. For example, the floccules 20 may be formed of siliconized polyester fibers 20 of about 12 mm in length and about 0.5 D. As another example, floccules 20 may be formed of siliconized polyester fibers 20 of about 12 mm in length and about 1.4 D. Similarly, floccules 10 of differing fibers 20 or fiber blends may be combined to form tuned blowable filling material or insulation. For example, the illustrated floccules 10 shown in FIGS. 1-6 are formed of about 50% siliconized polyester fibers 20 of about 12 mm in length and about 0.5 D and about 50% siliconized polyester fibers 20 of about 12 mm in length and about 1.4 D. As another example of blowable filling material or insulation formed of floccules 10 of differing fibers 20, the floccules 10 may be formed of about 35% siliconized polyester fibers 20 of about 12 mm in length and about 0.5 D, about 35% siliconized polyester fibers 20 of about 12 mm in length and about 1.4 D and about 30% conjugate polyester fibers 20 of about 12 mm in length and about 6 D.

As another example, the fibers 20 forming the floccules 10 may be particularly configured for dry environments (e.g., for certain fashion garments, non-performance items, home furnishings, etc.) or wet environments (e.g., outdoor and performance garments). In some embodiments, the fibers 20 may include a water repellency treatment effective to repel water or other liquid. As yet another example, the fibers 20 forming the floccules 10 may be configured to change shape, orientation or other parameters via a treatment process, such as heat and/or steam treatment. In some such embodiments the fibers 20 may be configured to coil or crimp (or coil or crimp to a greater degree) due to a treatment of the floccules 10. Such coil or crimping of the fibers 20 may act to increase the width W1 and/or thickness T1 of at least the medial portion 12 of the floccules 10, and/or the overall shape or configuration of the floccules 10. In some embodiments, the floccules 10 may be configured to undergo a treatment (e.g., heat and/or steam) that shapes the floccules 10. For example, the floccules 10 may be subjected to a treatment that curves the floccules 10 along their longitudinal length L3. Such a curved shape of the floccules 10 may act to increase the fill power and/or thermal resistance of the of the resulting material compared to a material of floccules 10 that extend substantially linearly along their longitudinal length L3.

As noted above, the structure of the fibers 20 of the floccules 10 may provide several of the advantageous qualities of down clusters, down fibers, or feathers. As shown in FIGS. 1-6, the fibers 20 of the floccules 10 are arranged to form the floccules 10 in an elongate shape with the expanded, loose medial portion 12 and the slender, tight, twisted tail portions 14 extending from opposing ends of the medial portion 12. As shown in FIGS. 3 and 5, the medial portion 12 is "open" such that the fibers 20 are loosely arranged or substantially spaced from one another. In this way, the density of the fibers 20 within the medial portion 12 is less than that of the tail portions 14. The open arrangement or spacing of the fibers 20 within the medial portion 12 acts to increase the surface area of the medial portion 12 (e.g., as compared to the tail portions 14) and allows air to flow into the structure. In this way, the floccule 10 may function similar to a sail to "catch" an airflow and fall slowly through air (i.e., "float"). The medial portion 12 thereby allows airflow of a blowing machine to efficiently carry or push the floccules 10 through the machine and into an article or substrate being filled thereby, and allows the floccules 10 to remain suspended in a feed chamber of the blowing machine for an extended period of time such that the floccules 10 are easily drawn up by the machine.

The fibers 10 of the medial portion 12 may extend at least generally along the longitudinal direction. However, as shown in FIGS. 3 and 5 the fibers 10 of the medial portion 12 may extend non-linearly along the longitudinal direction. For example, the fibers 20 of the medial portion 12 may randomly extend in the width and/or thickness directions as they generally extend in the longitudinal direction. As another example, the fibers 20 of the medial portion 12 may be substantially crimped, coiled, serpentine, sinusoidal or at least generally include any other non-linear pattern or orientation as they extend generally in the longitudinal direction. Similarly, the fibers 20 of the medial portion 12 may be intertwined or comingled in a defined pattern or may be configured in a random arrangement. For example, a fiber 20 of the medial portion 12 may be loosely twisted with one or more other fiber 20 of the medial portion 12. However, as a whole (i.e., rather than a few individual fibers 20), the fibers 20 of the medial portion may not be arranged in a tight, closed twisted pattern.

Figure 6:
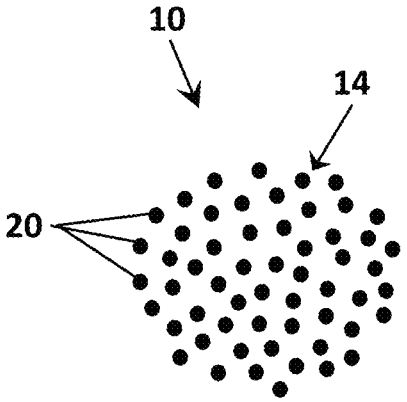
FIG. 6 illustrates a cross-sectional view of an exemplary tail portion of the floccule of FIG. 2 as indicated in FIG. 3.

As shown in FIGS. 3 and 6, as opposed to the expanded and loose arrangement of the fibers 20 of the medial portion 12, the fibers 20 of the tail portions 14 may formed into a relatively slender, closed, twisted arrangement. The tail portions 14 may be slender in that their width and/or thickness may be substantially less than that of the medial portion 12. As shown in the cross-section in FIG. 6, the tail portions 14 may define a substantially circular cross-sectional shape. In other embodiments, the cross-sectional shape of the tail portions 14 may be any non-circular shape that may or may not differ from a cross-sectional shape of the medial portion 12 (see FIG. 5).

Figure 4:
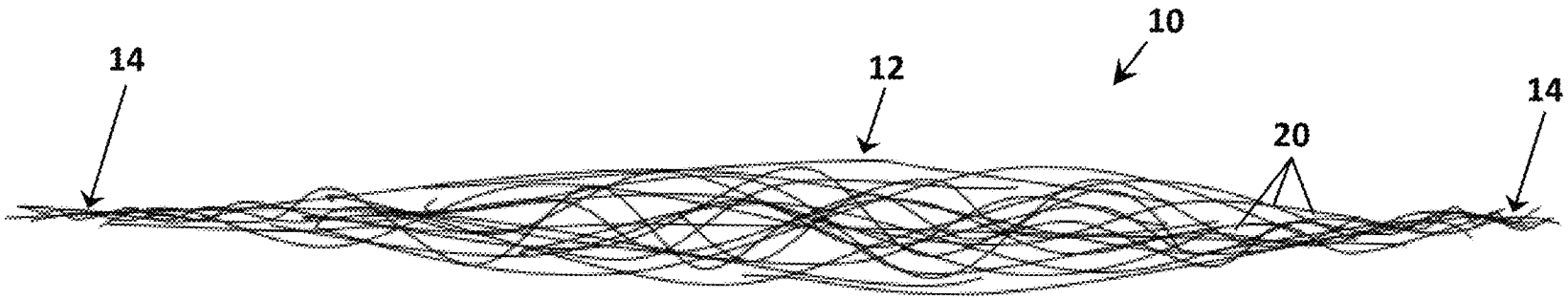
FIG. 4 illustrates a side view of the floccule of FIG. 2.

The fibers 20 of the tail portions 14 may be bundled or pulled together into a relatively tight or close relationship and arranged in a twisted or spiraling arrangement with each other as a whole, as shown in FIGS. 3 and 4. In this way, the tail portions 14 may become smaller in cross-sectional size as the fibers 20 extending from the medial portion 12 and are pulled/twisted together, as a whole, into the relatively tight closed twisted nature, as shown in FIGS. 3 and 4. The tail portions 14 may thereby include a substantially "closed" nature (e.g., as compared to the medial portion 12), as shown in FIG. 6, with a fiber density greater than that of the medial portion 12.

The slender, closed, twisted arrangement of the fibers 20 of the tail portions 14 and the expanded, open arrangement of the fibers 20 of the medial portion 12 allow the floccules 10 to align longitudinally in/with an air current (e.g., while traveling through a blowing nozzle) and maintain a free flowing nature. Further, the slender, closed, twisted arrangement of the fibers 20 of the tail portions 14 and the expanded, open arrangement of the fibers 20 of the medial portion 12 impart loft and a puffiness to an article or substrate filled with a plurality of the floccules 10. For example, the structure of the floccules 10 promotes the creation of air pockets therebetween, which may act to increase thermal resistance. The fibers 20 forming the floccules 10 may be staggered along their length (i.e., the fibers 20 may not be aligned along the longitudinal direction and extend the entire longitudinal length L3 of the floccules 10). For example, a particular fiber 20 may partially form both the medial portion 12 and at least one of the tail portions 14, or may only partially form a portion of the floccule 10.

The medial portion 12 and the tail portions 14 may include about the amount of fibers 20, or the medial portion 12 and the tail portions 14 may include a differing amount of fibers 20. For example, a particular medial portion 12 may include more fibers 20 than at least one of the corresponding the tail portions 14. Similarly, the tail portions 14 of a floccule 10 may include a different amount of fibers 20 with respect to each other. In some embodiments, the length L2, width, thickness, shape, arrangement or any other configuration of one of the tail portions 14 of a particular floccule 10 may differ from the other tail portion 14 thereof. The total number of discreet or individual fibers 20 per floccule 10 may vary, such as due to the particular configuration or composition of the fibers 20 being used. In some embodiments, the floccules 10 may include a total number of fibers 20 within the range of about 600 total fibers 20 to about 1,200 total fibers 20, or within the range of about 700 total fibers 20 to about 1,000 total fibers 20. In some embodiments, blowable insulation or filling material formed of a plurality of floccules 10 may include an average total number of fibers 20 per floccule 10 within the range of about 800 total fibers 20 per floccule 10 to about 1,050 total fibers 20 per floccule 10, such as about 875 total fibers 20 per floccule 10.

Figure 7:
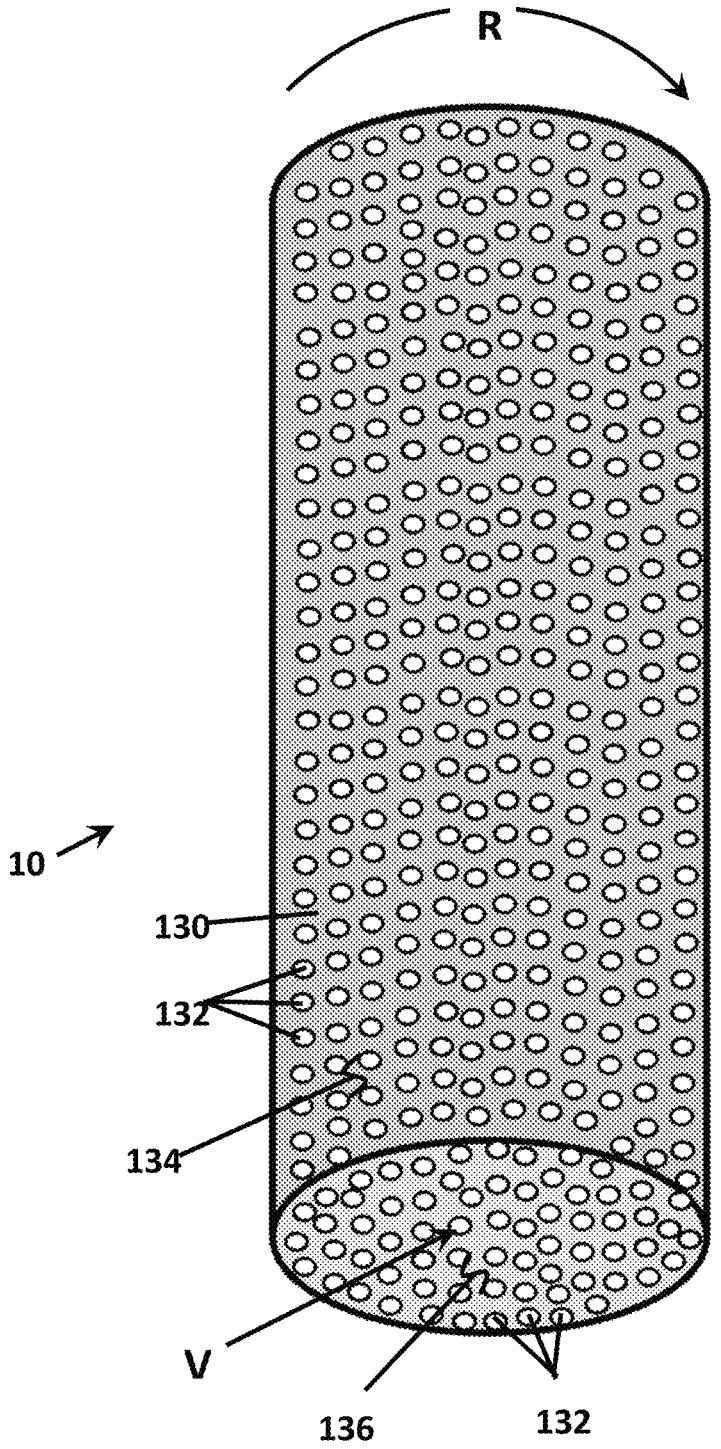
FIG. 7 illustrates an elevational perspective view of a mechanism for manufacturing blowable floccule insulation and for filling material according to certain embodiments of the present disclosure.

FIG. 7 illustrates an exemplary apparatus 110 and corresponding method for manufacturing the blowable filling material or insulation according to the present disclosure (i.e., a plurality of the floccules 10 disclosed herein). In some embodiments, the apparatus 110 and corresponding method may include aspects and/or operating parameters similar to that of a fiber ball manufacturing apparatus and method. As shown in FIG. 7, the apparatus 110 may include a hollow drum 130 that is configured to rotate at a frequency of rotation R. As also shown in FIG. 7, the hollow drum 130 includes a plurality of discrete apertures 132 extending through the drum 130 from an exterior surface 134 to an interior surface 136 thereof. The apertures 132 of the drum 130 may be any shape, size and configuration. In some embodiments, the apertures 132 may be substantially circular, rounded oval, pointed oval or a combination thereof. The shape of the apertures 132 may dictate, at least partially, the shape or configuration of the floccules formed thereby. In some embodiments, a portion of the drum 130 extending about or forming at least one of the apertures 132 may be raised or depressed with respect to the other portions of the drum 130 extending about or forming the at least one aperture 132. Stated differently, a portion of at least one of the apertures 132 may be formed by an outward or inward protruding portion of the drum 130.

In use, a vacuum pressure V may be created or formed within the interior of the hollow drum 130 while the drum 130 rotates at a frequency of rotation R. The frequency of rotation R of the drum 130 may be less than about 500 RPM, or within the range of about 100 to about 400 RPM. While the drum rotates 130, staple fiber (not shown) may be applied to the exterior surface 134 of the drum 130. The staple fiber may be a mass of the fibers desired to form floccules. For example, if it is desired that the floccules be formed of a fiber blend, the staple fiber may include such a desired fiber blend. In some embodiments, the staple fiber may be opened before being applied to the exterior surface 134 of the drum 130.

The vacuum pressure V formed within the drum 130 may be configured to pull a plurality of the fibers of the staple fiber applied to the exterior surface 134 through the apertures 132 as the drum 130 rotates at the frequency of rotation R. After the plurality of fibers are pulled through the apertures 132 of the rotating drum 130 via the vacuum pressure V, the fibers may at least generally form the floccule structure described herein.

The apparatus 110 may further be configured such that after the plurality of fibers are pulled through the apertures 132 and a preliminary floccule structure is formed, the partially-formed floccules remain within the rotating drum 130 for a dwell time. During the dwell time, the partially-formed floccules may tumbled over each other and against the interior surface 136 of the drum, and may potentially be translated along the length of the drum 130. The dwell time of the partially-formed floccules may act to further form the fibers thereof into the final configuration of the floccule structures, as disclosed herein. The dwell time of the partially-formed floccules within the rotating drum 130 may vary, such as due to the particular fiber composition, the particular fiber configuration, the desired final floccule structure, etc. In some embodiments, the apparatus 110 may be configured such that the dwell time of the partially-formed floccules within the rotating drum 130 is within the range of about 2 minutes to about 5 min.

In some embodiments, the frequency of rotation R of the drum 130 may be at least partially related to the dwell time. For example, the greater the frequency of rotation R of the drum 130, the shorter the dwell time of the partially formed floccules within the rotating drum 130 may be necessary to form the floccule structures disclosed herein. In one example, the frequency of rotation R of the drum 130 may be about 250 RPM and the dwell time of the partially formed floccules may be about 2 min. In another example, the frequency of rotation R of the drum 130 may be about 150 RPM and the dwell time of the partially formed floccules may be about 3 min.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the disclosure without departing from its scope. While the dimensions and types of materials described herein are intended to define the parameters of the disclosure, they are by no means limiting and are exemplary embodiments. Many other embodiments will be apparent to those of ordinary skill in the art upon reviewing the above description. The scope of the disclosure should, therefore, be determined with reference to the appended claims, along with the full scope of equivalents to which such claims are entitled.

In the appended description, the terms "including" and "in which" are used as the plain-English equivalents of the respective terms "comprising" and "wherein." Moreover, in the following claims, the terms "first," "second," etc. if any, are used merely as labels, and are not intended to impose numerical or positional requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

This written description uses examples to disclose several embodiments of the disclosure, including the best mode, and also to enable any person of ordinary skill in the art to practice the embodiments of disclosure, including making and using any devices or systems and performing any incorporated methods. The patentable scope of the disclosure is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

All publications cited in this specification are herein incorporated by reference as if each individual publication were specifically and individually indicated to be incorporated by reference herein as though fully set forth. Subject matter incorporated by reference is not considered to be an alternative to any claim limitations, unless otherwise explicitly indicated.

Where one or more ranges are referred to throughout this specification, each range is intended to be a shorthand format for presenting information, where the range is understood to encompass each discrete point within the range as if the same were fully set forth herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

The invention claimed is:

1. A method of making blowable insulation or filling material, comprising:

rotating a hollow drum including a plurality of apertures extending therethrough within the range of 100 RPM to 400 RPM;

forming a vacuum pressure within an interior of the rotating drum; and applying staple fibers to an exterior surface of the rotating drum such that the internal vacuum pulls a plurality of the staple fibers through a plurality of the apertures to partially form a plurality of floccules; and retaining the partially-formed floccules within the rotating drum for a dwell time within the range of 2 minutes to 5 minutes to form a plurality of discrete, longitudinally elongated floccules each including a relatively open enlarged medial portion and relatively condensed twisted tail portions extending from opposing ends of the medial portion.

2. The method according to claim 1, wherein the staple fibers comprise a denier within the range of 0.1 D to 8.0 D and a longitudinal length within the range of 5 mm to 55 mm.

3. The method according to claim 1, wherein the floccules comprise a longitudinal length within the range of 2 cm to 4.5 cm.

4. The method according to claim 1, wherein the staple fibers are synthetic fibers.

5. The method according to claim 4, wherein the staple fibers comprise polyester.

6. The method according to claim 1, wherein the staple fibers comprise siliconized fibers.

7. The method according to claim 1, wherein the staple fibers comprise a denier within the range of 0.1 D to 8.0 D.

8. The method according to claim 1, wherein the staple fibers comprise a longitudinal length within the range of 5 mm to 55 mm.

9. The method according to claim 8, wherein the staple fibers comprise a longitudinal length of less than or equal to 15 mm.

10. The method according to claim 1, wherein the longitudinal length of the medial portion of the floccules is within the range of 0.1 cm to 2 cm.

11. The method according to claim 1, wherein the longitudinal length of the tail portions of the floccules is within the range of 0.8 cm to 1.8 cm.

12. The method according to claim 1, wherein the medial portion of each floccule defines a total width and a total thickness that are greater than a total width and a total thickness, respectively, of the corresponding tail portion.

13. The method according to claim 12, wherein the total width of the medial portion of each floccule is greater than the total thickness of the medial portion.

14. The method according to claim 1, wherein the medial portion and the tail portions of at least some of the floccules extend substantially linearly along the longitudinal direction.

15. The method according to claim 1, wherein at least one of the medial portion and at least one of the tail portions of at least some of the floccules extend substantially non-linearly along the longitudinal direction.

16. The method according to claim 1, wherein the floccules comprise a fill power within the range of 250 and 800 cubic inches per 30 grams.

17. The method according to claim 1, wherein the staple fibers comprise fibers that differ in at least one of longitudinal length, denier and composition.

18. The method according to claim 1, wherein the floccules each include a total number of fibers within the range of about 600 total fibers to about 1,200 total fibers.

19. The method according to claim 1, further comprising mixing loose fibers that are not formed into floccules with a plurality of the formed floccules.

20. The method according to claim 1, wherein the blowable insulation or filling material comprises a fill power within the range of 250 and 800 cubic inches per 30 grams.

* * * * *